United States Patent [19]

Feld

[11] 3,941,366

[45] Mar. 2, 1976

[54] CLOTH LAYING CARRIAGE FOR ONE WAY OPERATION HAVING CLOTH CLAMPING CUTTING BOX

[75] Inventor: Jerome H. Feld, Brooklyn, N.Y.

[73] Assignee: Cutting Room Appliances Corporation, New York, N.Y.

[22] Filed: Jan. 24, 1974

[21] Appl. No.: 436,150

[52] U.S. Cl. ..... 270/31

[51] Int. Cl.[2] ..... B65H 29/46

[58] Field of Search ..... 270/30–31, 270/69

[56] References Cited

UNITED STATES PATENTS

| | | | |
|---|---|---|---|
| 1,809,213 | 6/1931 | Oesman | 270/30 |
| 3,233,488 | 2/1966 | Deichmann | 83/174 |
| 3,503,604 | 3/1970 | Martin | 270/31 |

*Primary Examiner*—E. H. Eickholt
*Assistant Examiner*—A. Heinz
*Attorney, Agent, or Firm*—Charles E. Temko

[57] ABSTRACT

A carriage assembly for automatic face up one way spreading of multiple plys of fabric or any other web-like material of a predetermined length, which is automated to operate in a continuous manner in the absence of operator manipulation at the termination of each fabric spreading cycle. The device incorporates a fabric or web-cutting assembly normally enclosing a transversely traveling severing blade and means for automatically engaging the free end of the fabric after sequenced severing so as to maintain the fabric in a fixed relation relative to the assembly during return or non-spreading carriage motion thereby preventing disturbance or change of position of the free end of the fabric as caused by carriage motion airflow, so that upon automatic recommencement of spreading, the end of the fabric will be deposited at a predetermined position on the spreading surface which will be accurately repeated for each subsequent automatically deposited ply of fabric, thereby providing maximum fabric utilization. Means is also provided for automatic locking or breaking of the fabric positive feed roller during carriage non-spreading return travel in such fashion that upon subsequent automatic recommencement of fabric spreading, the feed roller drive is engaged prior to complete feed roller unlocking so that fabric tension existing between the feed roller and supply spool is prevented from causing displacement of the free end of the fabric, thereby further insuring position accuracy of successive plys. Provisions are also made for preventing the severed edge of the fabric from catching within the confines of the cutting assembly.

7 Claims, 9 Drawing Figures

CLOTH LAYING CARRIAGE FOR ONE WAY OPERATION HAVING CLOTH CLAMPING CUTTING BOX

BACKGROUND OF THE INVENTION

This invention relates generally to the field of fabric spreading machines, and more particularly to a fabric spreading carriage or an attachment for an existing carriage adapted for so-called "face up, one way" operation in a completely automatic manner.

As known in the art, face up operation of the fabric spreading carriage is required when the fabric being spread is not identical on both surfaces thereof, necessitating a disposition of the fabric with like surfaces facing in the same direction. Such is the case when the derived multiple ply marker cut fabric sections are loaded into automated stitching systems without the need for turning over alternate plies. One way spreading is required when, in addition, the face of the fabric being spread consists of a longitudinal unilaterally-oriented design or texture, where by virtue of marker composition it is necessary that the fabric design or texture be oriented in the same direction in all plies of the fabric being spread. To meet the face up requirement, it is not posible to deposit the fabric on the spreading table as a continuous web, the layers of which are interconnected by 180° folds. Instead, with the deposition of each play of fabric, the web is severed at the end of the fabric spreading movement of the carriage over the table, and the following ply is independently positioned to overlie the ply previously spread. Where a substantial amount of one way work is required, it is common to provide in the carriage a turntable means for supporting the fabric supply, which is rotated through 180° at the end of each movement over the table, so that fabric may be laid in both directions with the same side facing upwardly. Spreading in this fashion is relatively expeditious since fabric is being spread in both directions of spreading machine travel. However, it does not provide for one way spreading. Where a turntable was not present it is common to provide an attachment for the carriage through which the fabric web passes. The attachment includes an elongated box having a cutting blade mounted for reciprocation transversely of the path of movment of the carriage. At the completion of the deposition of a singly ply of fabric the cutting means is operative to sever that ply of fabric, following which the carriage returns to the opposite end of the table, and the free edge of the severed web is manually threaded through the cutter box forming a part of the attachment, and a second ply is subsequently deposited upon the first one. Care must be exercised to align the edge of the web with the edge of the previously laid ply, in order not to waste fabric. Where the carriage includes a positively driven driven feed roller, it is customary to disengage the clutch connecting the feed roller with driving means powered by the movement of the carriage over the table, so that the cloth web may be manually adjusted prior to commencement of the cloth feed. This operation normally requires the opening of the cutter box, the threading of the web therethrough, the manual closing of the box, the pulling of fabric down to the table to the requisite degree, and the re-engagement of the clutch interconnecting the positive drive feed roll with its driving means. At the opposite end of the table, a limit switch on the carriage strikes a cam adjustably mounted on the table to stop the carriage, which action may automatically activate the web cutting blade in the cutter box, but operations at the first mentioned end of the table have been performed manually with a considerable expenditure of time on the part of skilled personnel.

It has been known in the art to completely automate fabric spreading carriages for continuous web deposition, so that while the device is in operation, little if any supervision on the part of an operator is necessary.

BRIEF DESCRIPTION OF THE PRESENT INVENTION

Briefly stated, the invention contemplates the provision of face up one way operation of automated carriages, in which the clamping of the end of the fabric web after severing of the previously spread segment is automatically performed on the carriage itself, and in which the positive drive roller which provides tensionless feeding of the web is simultaneously locked against movement. After the completion of a spreading cycle, the carriage returns to the other end of the fabric spreading table to commence a subsequent spreading operation. Means is provided to prevent loss of phase between the positive drive feed roller and the means driving the same upon recommencement of feeding, whereby the free end edge of the web is deposited with great accuracy upon the corresponding edge of the previously laid segment of fabric. The cutter box is provided with movable sides enabling the upper portion of one wall thereof to serve as a selective fabric web clamping means, and a lower portion containing the cutting trough can selectively move laterally with respect to the plane of the fabric web disposed therein to clear any potential sticking of the free end of the fabric web in the trough which would prevent or interfere with subsequent feeding. In the preferred embodiment, the clamping action is mechanical in nature and accomplished by the moving of one wall of the cutter box relative to an opposed wall. In another embodiment, the clamping and clearing functions are accomplished pneumatically.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENTS

Figure 1:
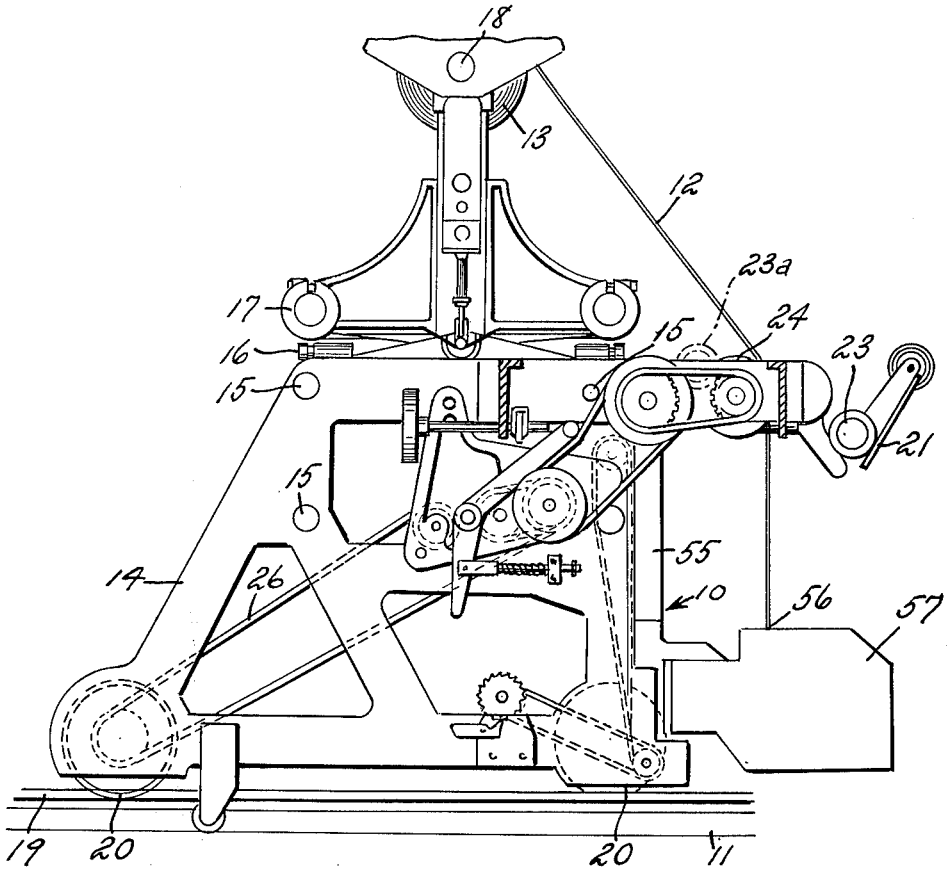
FIG. 1 is a side elevational view of a cloth laying carriage embodying the invention.

Referring to FIG. 1 in the drawings, there is shown a spreading machine 10 mounted to move along a table 11 to spread a web 12 of fabric or other material from a supply roll 13 of such material. The device 10 includes a pair of laterally spaced end frames, one of which is indicated by reference character 14, which are rigidly interconnected in spaced relation by tubular cross members 15 to define a carriage. Riding upon an upper pair of members 15 is a carrier 16 supporting in turn a turntable 17 which mounts a fabric supply spindle 18 carrying the roll 13. The above structure is described in greater detail in U.S. Pat. No. 3,233,488 granted Feb. 8, 1966, and assigned to the same assignee as the instant application. Reference is made to said patent for a detailed description of this structure.

Figure 7:
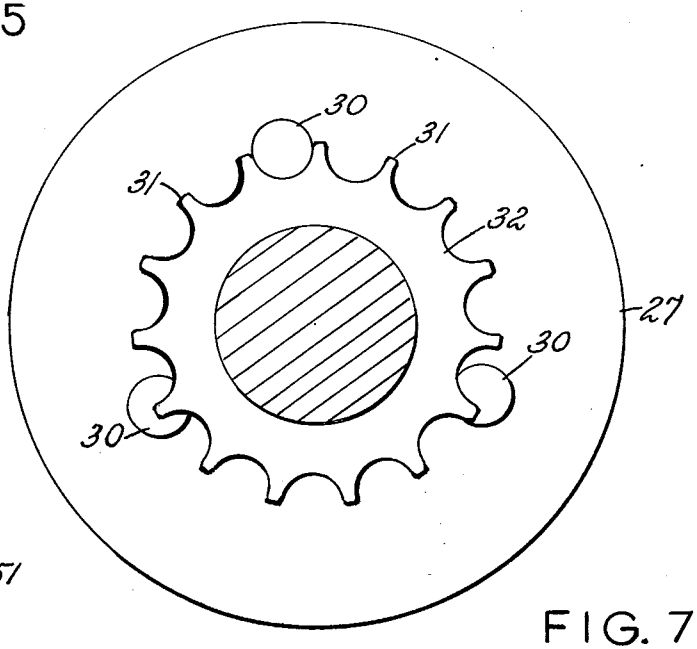
FIG. 7 is an enlarged sectional view as seen from the plane 7—7 in FIG. 6.
Figure 6:
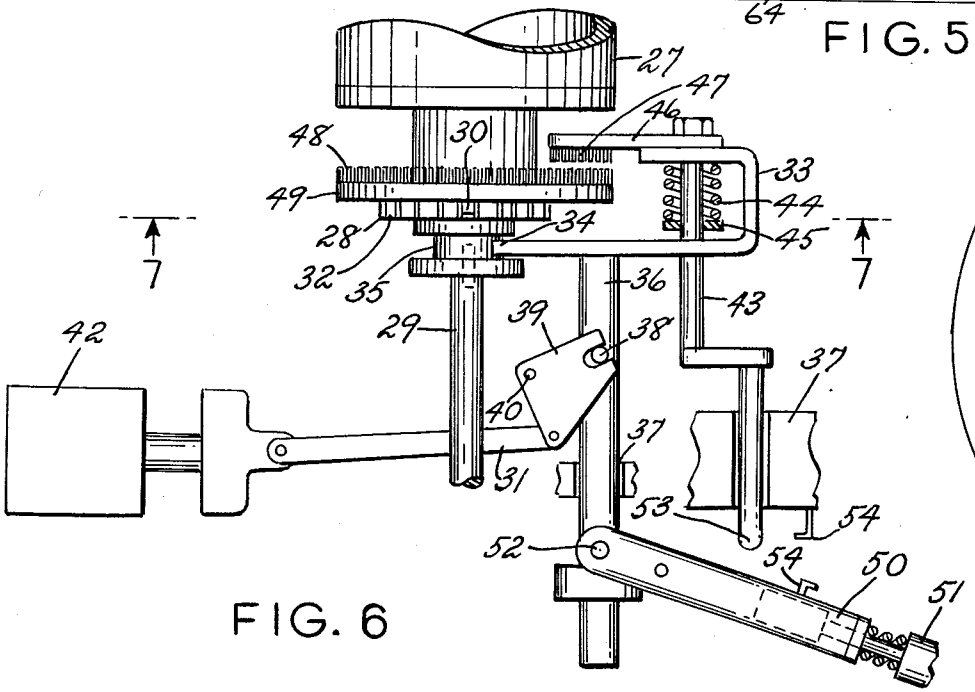
FIG. 6 is a fragmentary top plan view showing the details of means for driving a positive drive fabric feed roller, and locking same against movement during the return stroke of the carriage.

In order to properly guide the carriage 10 for movement longitudinally over the table, one or more tracks 19 are secured to at least one longitudinal edge thereof. The wheels 20 of one of the frames 14 is guided by the track 19 in well known manner. possible To insure contact between the fabric and the positive drive feed roller 24, there is provided a swingable frame 21 comprising an opposed pair of end frames, one of which is indicated by reference character 22 which are interconnected by a tie rod 23 and roller 23*a*. Roller 23*a* causes the fabric to contact approximately half of the positive feed roller surface. The positive drive feed roller 24 receives motion from a left hand wheel 20 through a sprocket chain 26, the interconnection being a well known type which results in rotation of the positive drive feed roller 24 in a clockwise direction as seen in FIG. 1, irrespective of the direction of movement of the carriage, and causes the feed roller peripheral speed to be equal to the speed of the carriage over the spreading surface thereby spreading the fabric in a tensionless fashion. Referring to FIG. 6, a clutch means 28 permits disengagement of the roll member 27 from transmitted movement of the sprocket chain 26. This means includes a driven shaft 29 coaxially aligned with the roll 24. A plurality of resiliently mounted drive pins 30 project axially of the roll 24 and are adapted to be engaged between the teeth 31 of a sprocket 32 on the shaft 29. As seen in FIG. 7, the pins 30 are three in number, and are positioned in even increments unrelated to the pitch of the teeth on the sprocket, so that upon re-engagement, one of the pins will be more nearly aligned for engagement than the others, and only limited rotation of the sprocket will occur before a pin 30 snaps into position in an interstice between the teeth. In the case of a sprocket having 16 teeth, the maximum amount of lost motion is 3.75° of rotation, with a four inch diameter feed roller, will effectively start the spread of each ply of fabric within approximately one eighth inch of a reference line on the spreading surface, thus insuring maximum utilization of fabric.

Referring again to FIG. 6, a C-shaped yoke 33 includes a projection 34 riding in a groove 35 of the hub of the sprocket 32. The yoke mounts a laterally extending control shaft 36 support in a bearing 37, the shaft having laterally projecting pins 38 engageable with a bell crank member 39 mounted for pivotal movement about a vertical axis 40. A connecting link 31 is interconnected to the armature of an operating solenoid 42, and it will be apparent that energizing and de-energizing of the solenoid will result in shifting of the yoke upwardly and downwardly as seen in FIG. 6 to engage or disengage the sprocket 32 with one of the pins 30.

A slideably mounted linkage 43 is urged to the position shown in FIG. 6 by a coil spring 44 bearing against a collar 45 secured to linkage 43. The linkage 43 includes a laterally extending member 46 having a brake facing 47 selectively engageable with a corresponding facing 48 on a plate 49 in fixed relation to the roll 24. The brake facings consisting of densely distributed stiff fibers, permits partial braking prior to complete disengagement of the drive pins thus preventing fabric spreading start position error due to feed roller rotation caused by fabric tension. A manual release 50 permits disengagement of the brake facings 47 and 48 when free rotation of the feed roller 24 is desired, as, for example, when initially threading a fresh roll of fabric prior to commencement of spreading. The release 50 includes a pivotally mounted handle 51 rotating about a point 52 (see FIG. 6) in a counter clockwise direction, wherein it strikes an offset link 53 to move the same upwardly, compressing the spring 44. Suitable latching means 54 may be included if desired.

Referring again to FIG. 1, a pair of U-shaped channel members, one of which is indicated by reference character 55 supports a fabric web cutting element 56 including a cutter box 57 supporting for transverse reciprocation a cutter assembly 58 the details, again, of which are disclosed in the above mentioned U.S. Pat. No. 3,233,488, and which form no part of the present disclosure. Mounting brackets 59 (FIG. 2) enable the cutter box to be detachably supported by the carriage 10.

Figure 5:
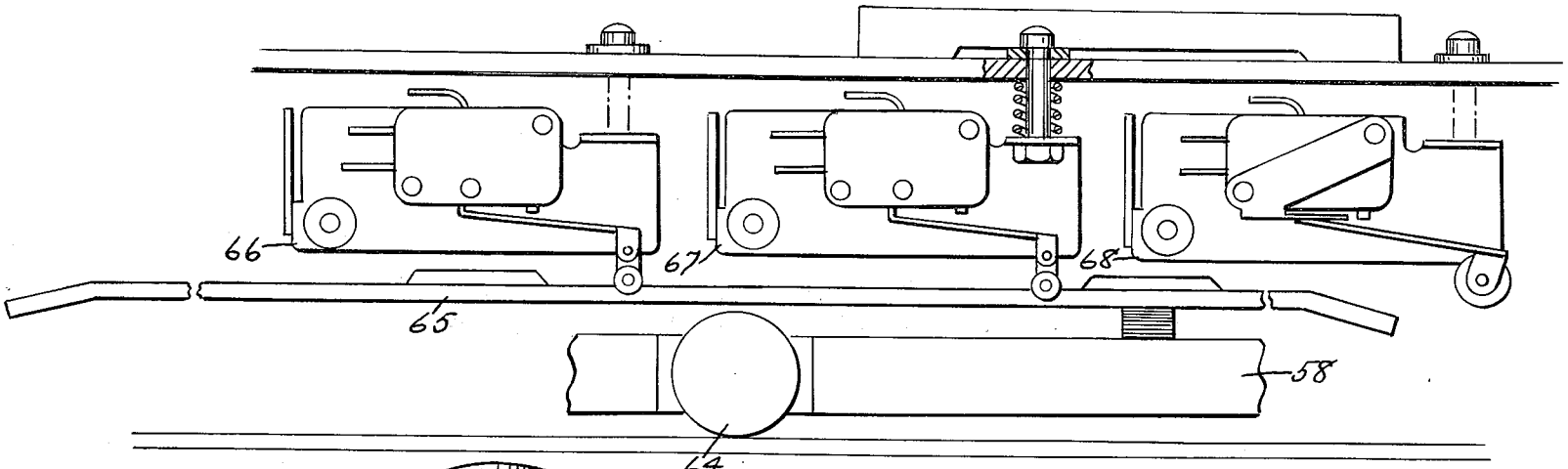
FIG. 5 is a fragmentary vertical sectional view showing the details of the actuation of cutter box snap actuating switches.
Figure 8:
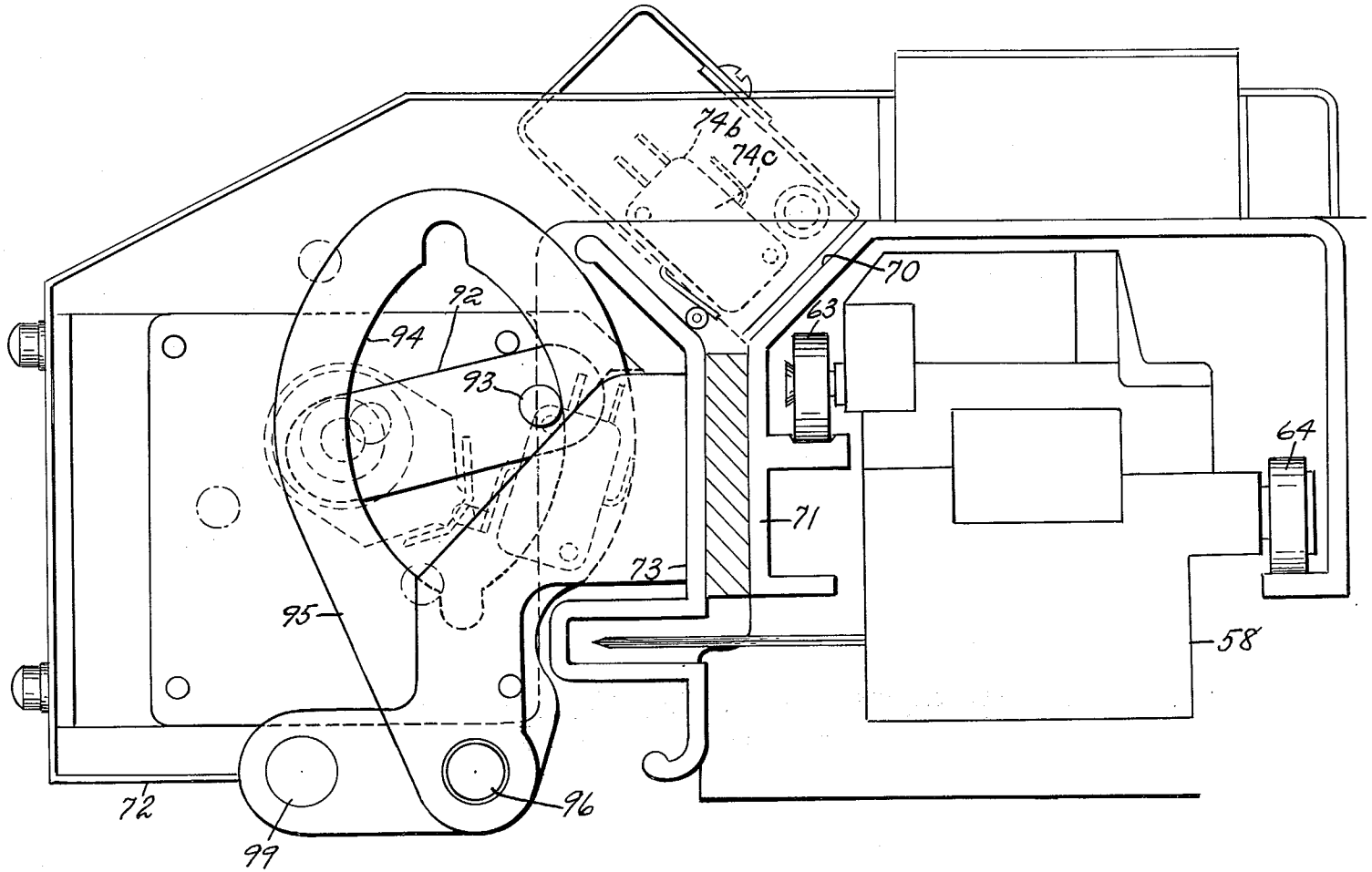
FIG. 8 is a transverse sectional view of the cutter box showing the cam actuating means for moving the movable walls thereof.

Referring to FIGS. 5 and 8, the cutter assembly 58 is supported on first and second sets of rollers 63 and 64, respectively, and supports a switch tripping bar 65 which progressively actuates at each end thereof first, second and third switches 66, 67 and 68, the function of which will be described hereinafter.

Figure 3:
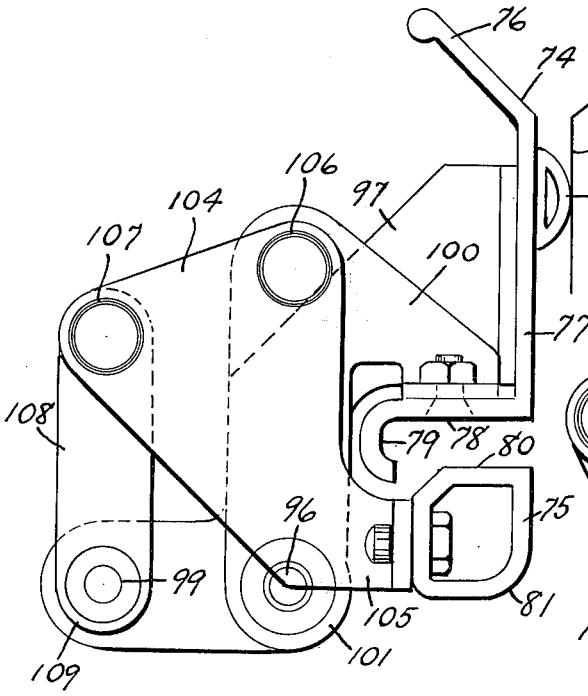
FIG. 3 is a fragmentary enlarged transverse sectional view as seen from the plate 3—3 in FIG. 2.
Figure 4:
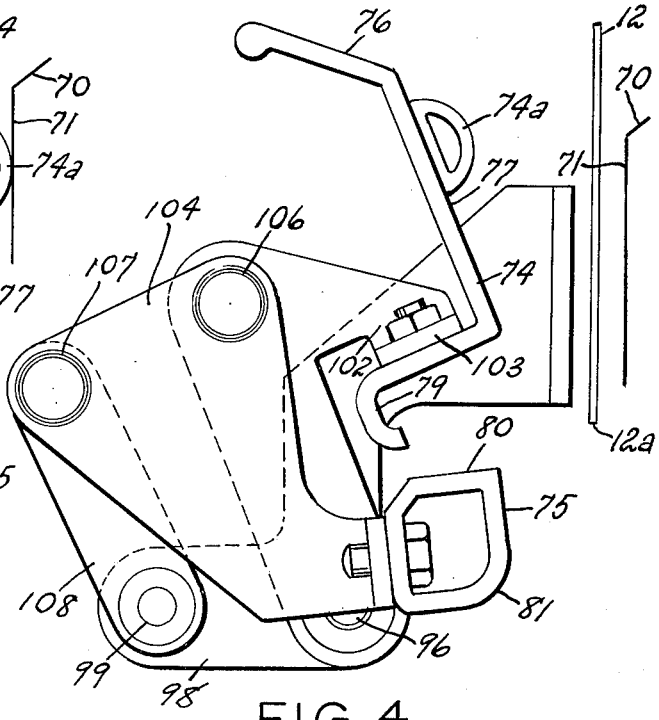
FIG. 4 is a sectional view, similar to that seen in FIG. 3, but showing certain of the component parts in altered relative position.

Referring to FIGS. 3, 4 and 8, the cutter box includes an angularly disposed wall section 70 and vertical wall section 71 forming part of a channel through which the cloth web passes. An outer wall assembly consists of a movable outer wall 73 including an upper wall member 74 mounting a resilient clamp 74*a*, and a lower wall member 75. The upper wall member 74 includes an angularly disposed portion 76 symmetrical with the wall 70 and a vertical portion 77 symmetrical with the wall 71, as well as horizontal portion 78 and short vertical portion 79 forming a part of the trough in which the cutting blade of the cutter assembly 58 moves during a severing operation. The lower wall member 75 forms the remaining portion of the trough, and includes a horizontal portion 80 and a vertical outwardly flared portion 81.

Figure 2:
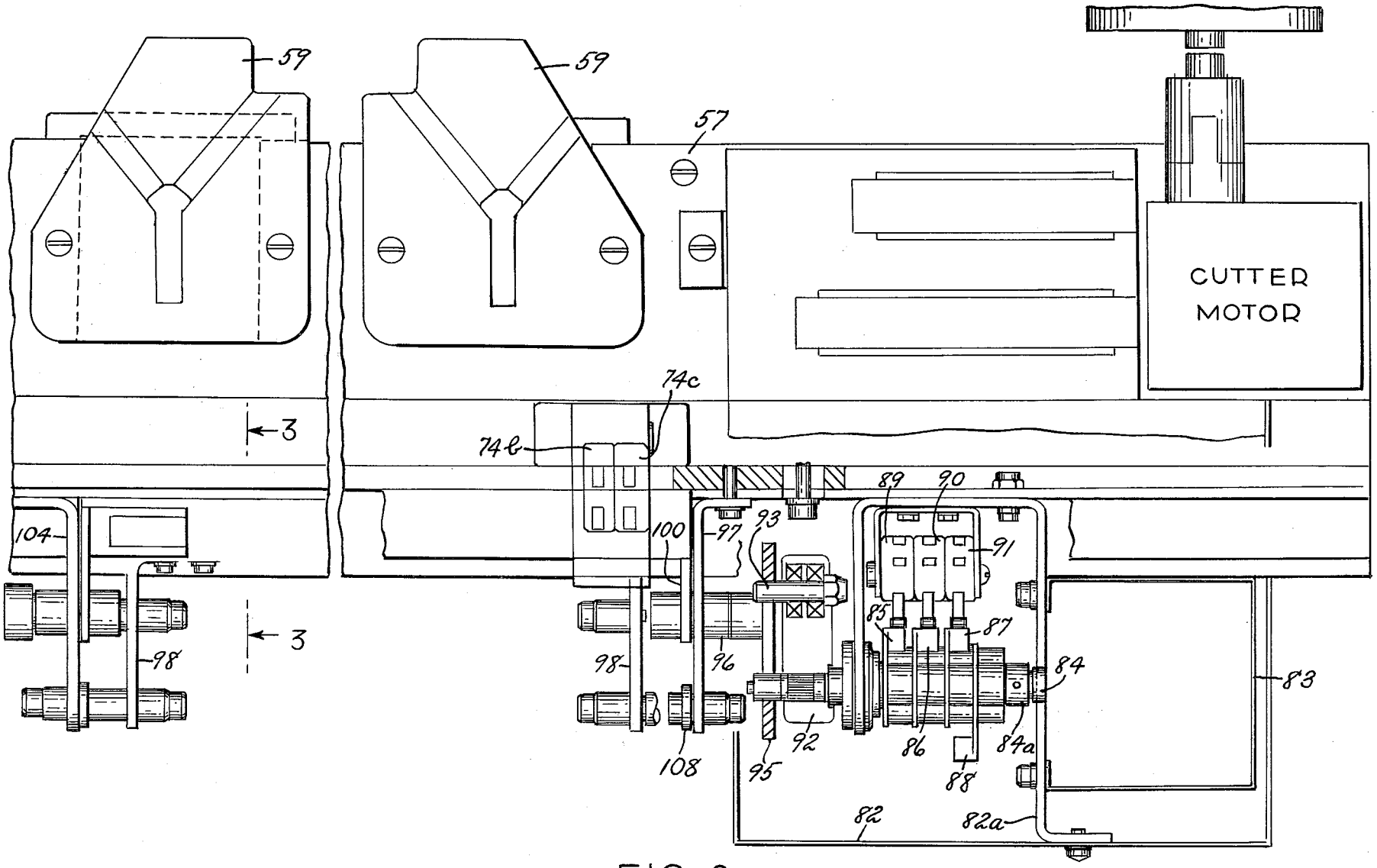
FIG. 2 is a fragmentary top plan view of a cutter box attachment forming a part of the disclosed embodiment.

Referring to FIG. 2, a housing 82 encloses a bracket 82*a* disposed at each of the cutter box which mounts a motor or rotational solenoid 83 having an output shaft 84 and shaft extension 84*a*, mounting first, second, third and fourth cams 85, 86, 87 and 88, respectively. The cams 85-88 are positioned to engage first, second and third switches 89, 90 and 91, respectively, to accomplish functions described hereinbelow. The shaft extension 84*a* mounts a crank 92 having a pintle 93 bearing against the surface of an opening 94 in an internal cam lever 95 as shown in FIG. 8. The motor driven crank 92 causes the pintle 93 to move in a counterclockwise circular orbit about shaft extension 84*a* without causing cam lever 94 to rotate, since the internal cam surface radius is equal to the outer orbit radius of pintle 93. As the pintle enters the lower cam notch it causes cam 95 to rotate until the opposite internal cam surface is contacted. The crank arm drive motor does not require precise control since the pintle may be stopped at any position between the lower and upper notches without causing arm lever rotation. The cam lever is caused to move in the opposite direction as the pintle enters the upper notch. Where the width of the cutter box is less than 72 inches, the above structure may be required at only one end of the cutter box. Greater widths of the cutter box will require symmetrically positioned simultaneously operating structure.

As shown in FIGS. 2, 3, and 4, the cam lever 95 is mounted upon a shaft 96 supported in a bracket 97 at each end of the cutter box. An extension of bracket 97 supporting the shaft 96 determines a fixed pivot point 99 on the same horizontal level as the shaft 96. An upper wall bracket 100 has a lower end 101 fixed to the shaft 96 for rotation therewith, and a longitudinally extending member 102 having a flange 103 abutting an outer surface of the upper wall member 74 to which it is interconnected. A lower wall bracket 98 includes a lower end 105 mounting the lower wall member 75. This bracket includes a first pivot point 106 interconnected to the upper wall bracket 100, and a second pivot point 107 interconnected with a link 108, the opposite end 109 of which is mounted for rotation about the point 99.

A comparison of FIGS. 3 and 4 illustrates the movement of the upper and lower wall members 74 and 75 between the relatively open and closed positions. It should be observed that when the cutter box is closed during the return stroke of the fabric spreading carriage, elastomeric lamp 74*a* prevents disengagement of the severed fabric end 12*a* due to carriage motion caused air pressure. The cutter box is opened as in FIG. 4 to unclamp the fabric and permit unimpeded movement of the fabric. The lower wall member 75 is simultaneously moved away from the closed position in order to avoid entrapment of the severed fabric end 12*a* as it descends at the commencement of fabric spreading.

OPERATION

Assume the carriage 10 to start the commencement of the spreading of a ply of fabric with the cutter box 57 in open condition as shown in FIG. 4, the clutch means 28 engaged and brake 48 disengaged. The carriage 10 will move leftwardly as seen in FIG. 1, to an end of the table 11, where it is stopped by contact with cams on the table operating switches on the carriage (not shown) as well known in the prior art. In prior art constructions, a similar switch causes operation of the cutter assembly 58. In the present embodiment, the corresponding switch commences operation of the motor 83 which rotates the crank 92 through approximately 180° where actuation of switch 91 removes power from motor 83 and where cam lever 95 is caused to close the upper and lower wall members 74 and 75, resulting in the clamp strip 74*a* engaging the fabric web 12 between it and the wall 71, this motion simultaneously closing a switch 74*b*. The movement of the output shaft 84 has also caused cam 86 to close switch 90. The switch 90 is in series with switch 74*b*, a completed circuit serving to commence operation of the cutter assembly 58 to traverse the length of the cutter box in either direction whereby the web 12 is severed. As the cutter assembly reaches the end of its stroke, the corresponding switches 66, 67 and 68 are closed. Switch 68 reverses the direction of current to the motor driving the cutter assembly, thus readying it for the subsequent cutting operation. Switch 67 connects current to the motor driving the carriage 10 causing it to commence movement in an opposite direction (rightward as seen in FIG. 1), and switch 66 upon contact opens the circuit to the cutter assembly motor at the end of the path of travel of the cutter assembly.

The actuation of switch 91 having stopped, the motor 83 maintains the wall 73 and 74 in closed condition. Switch 74*c* having been actuated by the closing of wall 74 operates the solenoid 42 to disengage the clutch means 28 and engage the brake facings 47 and 48 whereby the web is not only clamped by the strip 74*a*, but the positive drive roll 24 is locked to prevent any shifting of phase between spreading cycles.

With the walls 74 and 75 in closed condition, and the positive drive roll 24 locked against movement, the carriage 10 returns to the opposite end of the table, where corresponding switches (not shown) halt the carriage and again energizes the motor 83 which rotates the output shaft 84 through approximately another 180° until the fourth cam 88 again contacts the third switch 91 and stops the motor 83. During this rotation, cams 85 and 86 part contact with the followers of switches 89 and 90, the walls 74 and 75 are caused to open and the clutch means 28 becomes reengaged. The carriage again commences leftwardly as seen in FIG. 1 to resume feeding of the fabric web for subsequent ply. This operation continues automatically until the supply of fabric is exhausted or the device manually stopped.

It will be observed that by virtue of the fact that the fabric web is intermittently clamped within the cutter box itself, the fabric feed roller is prevented from rotating at any time during non-spreading carriage motion, and minimal backlash is experienced in engagement of the fabric feed roller clutch pins at the start of spreading, so there is no requirement for a catcher or other fabric clamping means at one end of the table to assure retention of the superimposed fabric plys in proper relation. Further, since loss of phase is effectively prevented, there is no need to manually align each succeeding cut edge with the edge of a fabric ply previously deposited on the table.

Figure 9:
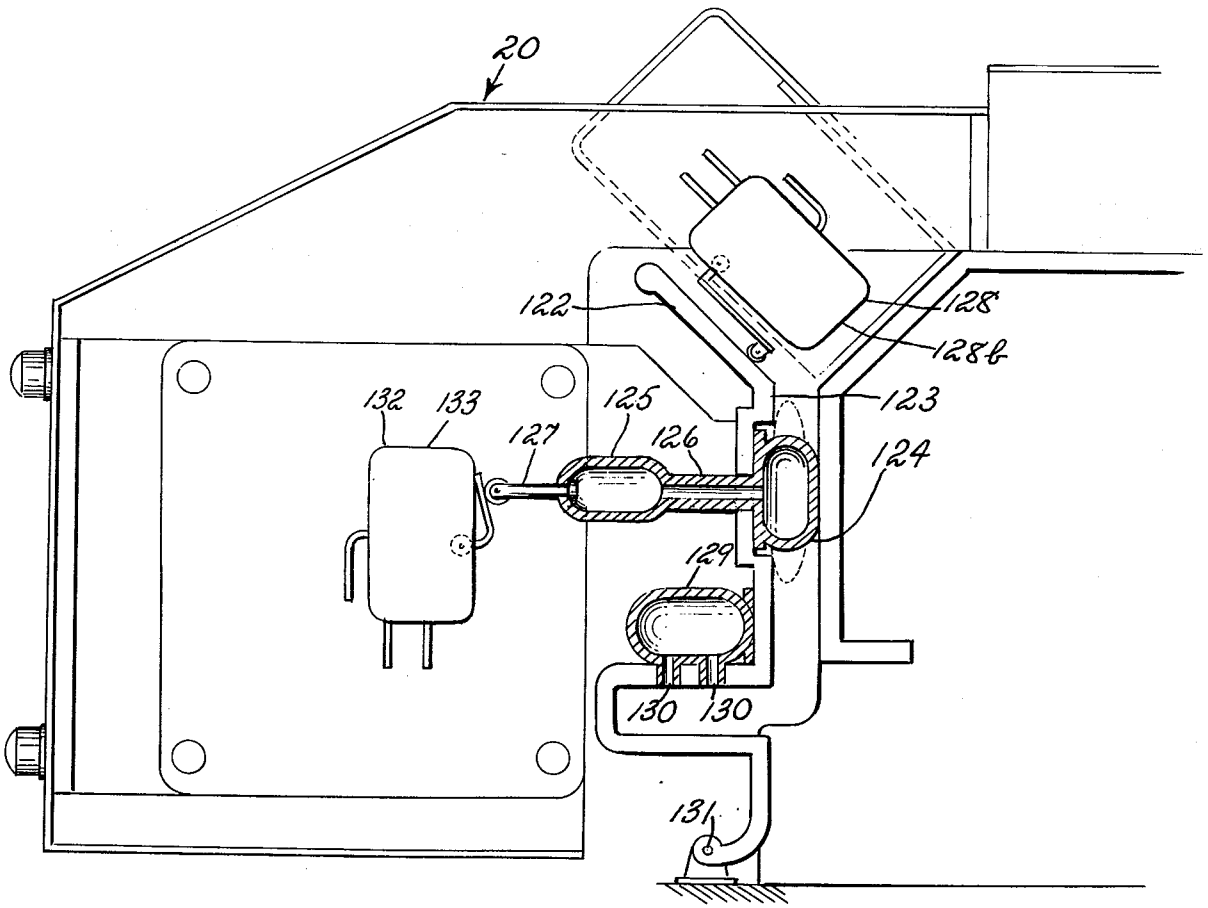
FIG. 9 is a transverse sectional view of the cutter box of a second embodiment of the invention.

Turning now to the second embodiment of the invention illustrated in FIG. 9, the device, generally indicated by reference character 20 differs from the principal embodiment in the execution of the clamping action within the cutter box by pneumatic means rather than mechanical movement of the wall members 74 and 75.

The embodiment includes a fixed outer wall 122, the inner surface 123 of which is provided with an inflatable strip 124 forming a clamping means. A compressed air manifold 125 supplied air through a tube 126 to the clamp 124 and operates an air piston 127 operating a switch 128 corresponding to the switches 74*b* and 74*c*. The switch 128 can also be actuated by the closed door, as is switch 74*b* and 74*c*. Where this is done, the piston 127 actuates switches 132 and 133 which are the equivalent of switches 89 and 90 in FIG. 2 of the principal embodiment.

A second manifold 129 supplied compressed air to a plurality of jet openings 130 which continuously or intermittently supply air to the cutting trough, to prevent the catching of a cut edge of the web after a severing operation. the wall 122 may be pivoted at 131 and maintained in closed condition by manually operated latch means (not shown) whereby the wall 122 may be opened for an initial threading operation required at the commencement of the loading of a fresh roll of cloth.

I wish it to be understood that I do not consider the invention limited to the precise details of structure shown and set forth in this specification, for obvious modifications will occur to those skilled in the art to which the invention pertains.

I claim:

1. In a fabric spreading machine carriage including means for supporting a web of fabric for dispensing in successive layers upon the surface of a cloth laying table disposed therebeneath, a positively driven roller entraining said web, and moving the same in linear correspondence to reciprocal movement of said carriage over said table for deposition upon said table in successive layers, the improvement comprising: a housing generally transversely oriented with respect to the principal axis of movement of said carriage over said table, web cutting means disposed within said housing and arranged for movement laterally with respect to said principal axis to sever a web of fabric positioned within said housing, web clamping means on said carriage adjacent said web cutting means selectively engaging the cut end of a web entrained on said roller, said web clamping means having a first operative position in which it engages said web to prevent movement thereof through said housing, and a second inoperative position in which movement of said web through said housing is in response to movement of said positively driven roller; first switch means carried by said carriage and actuated by movement of said carriage over said table for controlling the position of said clamping means such that movement of said carriage in a first direction results in movement of said clamping means to said first position, and movement of said carriage in a second opposite direction results in movement of said clamping means to said second position; said positively driven roller having clutch means for disengaging said roller from driven movement, and second switch means controllig operation of said clutch means between engaged and disengaged positions, said second switch means being controlled by movement of said carriage over said table; the relationship between said first and second switch means being such that during movement of said carriage in a given direction, said clamping means is in second inoperative position, and said clutch means is engaged whereby said positively driven roller moves said web through said housing, and during movement of said carriage in a direction opposite said given direction, said web clamping means is in said first operative condition, and said clutch means disengages said positively driven roller from the driven movement.

2. Structure in accordance with claim 1, further characterized in said web clamping means having first and second laterally extending walls defining upper and lower openings through said web of cloth may descend when said clamping means is in said second inoperative position.

3. Structure in accordance with claim 2, including means for moving said second wall towards said first wall to effect a cloth web clamping action.

4. Structure in accordance with claim 3, further characterized in said web cutting means including a trough formed in said second wall, a rotating blade slideably disposed at least partially within said trough, movement of said second wall away from said first wall serving to locate said blade outwardly of said trough.

5. Structure in accordance with claim 4, further characterized in said second wall including upper and lower pivotally mounted segments, part of said clamping means being mounted on said upper segment, and said trough being located in said lower segment.

6. Structure in accordance with claim 2, further characterized in said clamping means including a pneumatically inflatable member mounted on one of said first and second walls, and in inflated condition adapted to vary the effective distance between said inflatable member and the inner surface of the other of said first and second walls.

7. Structure in accordance with claim 2, further characterized in one of said walls defining a trough, said cutting means including a blade at least partially disposed within said trough during a cutting operation, and pneumtic jet means for moving outwardly of said trough a free edge of cloth entrapped therein at the complete of a cutting operation.

* * * * *